US006772658B1

(12) United States Patent
Jasick

(10) Patent No.: US 6,772,658 B1
(45) Date of Patent: Aug. 10, 2004

(54) COMBINATION PLIERS

(76) Inventor: Guy Arthur Jasick, 5018 Buffwood Way, Sacramento, CA (US) 95841

( * ) Notice: Subject to any disclaimer, the term of this patent is extended or adjusted under 35 U.S.C. 154(b) by 0 days.

(21) Appl. No.: 10/177,975

(22) Filed: Jun. 19, 2002

(51) Int. Cl.[7] ..... B25B 7/02
(52) U.S. Cl. ..... 81/418; D8/52
(58) Field of Search ..... 81/418, 426; D8/52

(56) References Cited

U.S. PATENT DOCUMENTS 246,062 A * 8/1881 Blaisdell ..... 81/426
1,677,909 A * 7/1928 Wade ..... 81/426
3,498,157 A * 3/1970 McKillip ..... 81/418
D254,563 S * 3/1980 Nihizer ..... D8/52
4,306,336 A * 12/1981 Kovar ..... 81/426
4,841,821 A * 6/1989 Cooper ..... 81/426
6,367,357 B1 * 4/2002 Thomas ..... 81/426

* cited by examiner

*Primary Examiner*—James G. Smith
(74) *Attorney, Agent, or Firm*—Risto A. Rinne, Jr.

(57) ABSTRACT

An apparatus for temporarily securing an object includes a first jaw that includes a needle-nose shape that is less than three-eight's of an inch thick and an opposite second jaw that includes a shape that resembles a letter "C" and has a throat depth that exceeds one inch. The first jaw includes a plurality of serrations along an inner surface for a predetermined longitudinal length. A clamping embodiment and two non-clamping embodiments are described.

6 Claims, 2 Drawing Sheets

COMBINATION PLIERS

BACKGROUND OF THE INVENTION

1. Field of the Invention

The present invention, in general, relates to devices that are adapted to clamp two objects together and, more particularly, to pliers.

Many types of pliers and clamps are known and are used to solve a variety of problems. Some have deep throats to fit around objects and some have small thin noses for working in tight quarters.

Some are adjustable, (i.e., channel lock pliers) and some are adapted to lock in a closed position (i.e., VICE-GRIP™ types of pliers.

However, there exists at least one application for which no existing tool is satisfactory. When assembling metal studs used for building construction, these metal studs fit into a track and are then screwed in position. It is necessary to first secure the metal stud in the desired position and attitude (i.e., vertical) to the track before fastening it thereto.

It is necessary for such a tool to have a deep throat to allow passage around the stud on one end and it is also necessary to have an especially thin nose on the opposite side to fit into a tight space. The thin nose binds against the track and it is therefore necessary that the thin nose include some friction enhancing method so that it resists movement during use. It is preferable that the pliers be adapted to lock in position as well.

Accordingly, there exists today a need for combination pliers that are adapted to fit in tight quarters on one side thereof (i.e., one jaw) and which are adapted to extend around an object on the opposite side (i.e., opposing jaw).

Clearly, such an apparatus would be a useful and desirable device.

2. Description of Prior Art

Pliers are, in general, known. For example, the following patents describe various types of these devices:

U.S. Pat. No. 5,050,466 to Cameron, Sep. 24, 1991;

U.S. Pat. No. 2,937,677 to McIlwain, May 24, 1960;

U.S. Pat. No. 2,894,547 to Lampe, Jul. 14, 1959;

U.S. Pat. No. 2,731,932 to Petersen, Jan. 24, 1956;

U.S. Pat. No. 2,362,707 to Malmquist, Nov. 14, 1944; and

U.S. Design Pat. No. 199,039 to Bolinger, Jr., Sep. 1, 1964.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide combination pliers that are adapted to fit in a tight space on one side and to encompass an object on the opposite side.

It is also an important object of the invention to provide combination pliers that include a first jaw that includes a needle nose and a second opposite jaw that includes a deep throat.

Another object of the invention is to provide combination pliers that include a first jaw that includes a needle nose and a second opposite jaw that includes a C-clamp type of shape.

Still another object of the invention is to provide combination pliers that include a first jaw that includes a needle nose with a serrated inner surface and a second opposite jaw that includes a deep throat.

Still yet another object of the invention is to provide combination pliers that include a first jaw that includes a needle nose and a second opposite jaw that includes a deep throat and is adapted to lock in a closed position.

Yet another important object of the invention is to provide combination pliers that include a first jaw that includes a needle nose and a second opposite jaw that includes a deep throat that is adjustable in its opening size.

Briefly, a combination pliers apparatus for use in clamping or securing two objects together that, is constructed in accordance with the principles of the present invention has a first jaw that includes a needle nose and a second opposite jaw that includes a deep throat. The first jaw includes a serrated inner surface to increase friction. The combination pliers preferably are adapted to releasably lock in a closed position. According to a first modification, a first modified combination pliers includes the above jaw elements and an adjustable opening size in a channel-lock configuration and according to a second modification, a second modified combination pliers includes the above jaw elements in a standard pliers configuration.

DETAILED DESCRIPTION OF THE INVENTION

Figure 1:
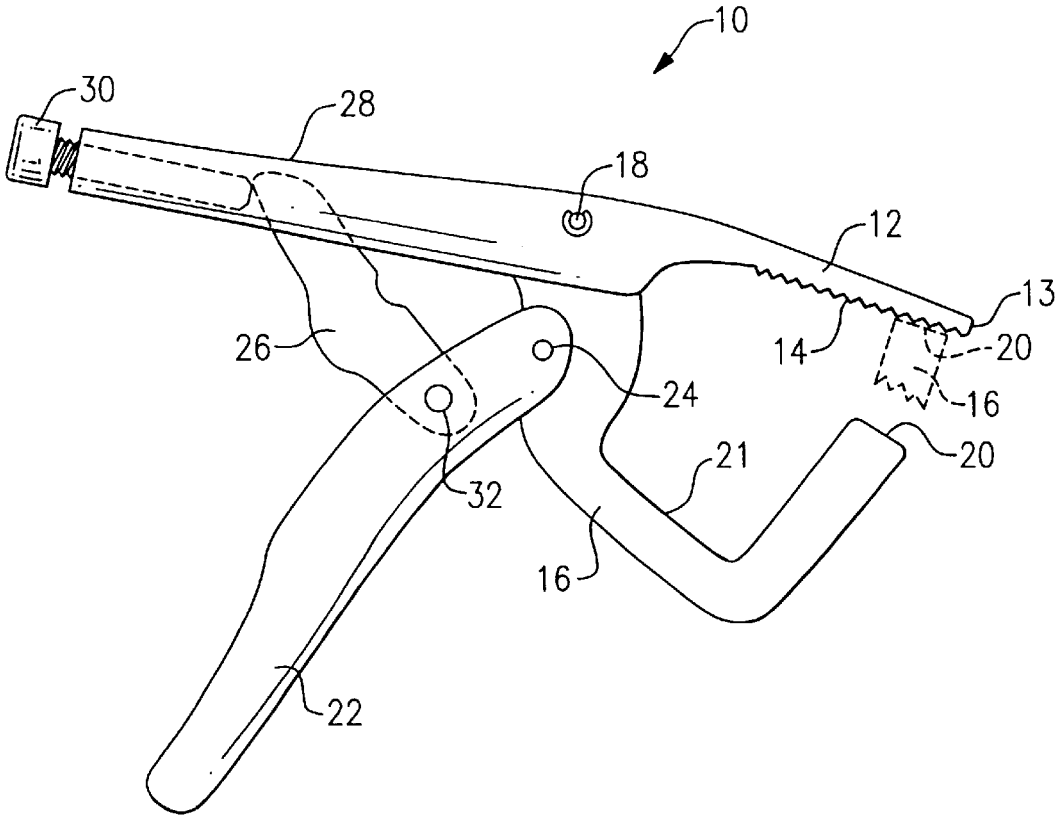
FIG. 1 is a side view of the preferred combination pliers in a locking, VICE-GRIP™ configuration.

Referring to all of the drawings and in particular now to FIG. 1 is shown, a combination pliers, identified in general by the reference numeral 10.

The pliers 10 include a first jaw 12 that includes a needle nose 13. The first jaw 12 includes serrations 14 on an inside surface to increase friction, and therefore gripping ability.

The first jaw 12 does not include a depth from the serrations 14 to the side opposite the serrations 14 that is greater than three-eight's of an inch.

A second jaw 16 is adapted to pivot about a first axis 18 with respect to the first jaw 12 from an open position (shown) into a closed position in which a tip 20 bears against a portion of the serrations 14 (dashed lines).

Note that the serrations 14 extend for a greater distance than the area of contact afforded by the tip 20, which makes for contact to occur primarily near the needle nose 13 end of the first jaw 12. The greater length of serrations 14 improves the ability of the pliers 10 to retain its position during use (i.e., when closed).

A pivoting handle 22 pivots about a second axis 24 and urges a member 26 toward an opposite handle 28. The member 26 is retained in a groove in the opposite handle 28 where it can extend or retract longitudinally to adjust the opening (i.e., the distance) intermediate the first jaw 12 and the second jaw 16 as required to secure different thickness objects there-between.

The opposite handle 28 is attached to the first jaw 12. The second axis 24 is provided through the second jaw 16. An adjustment screw 30 extends out of the opposite handle 28 at an end thereof that is distally disposed with respect to the first jaw 12. The member 26 pivots about a third pivot axis 32 that is attached to the pivot handle 22.

The adjustment screw 30 limits the travel of the member 26 in a direction that is away from the first jaw 12. The member 26 is urged away from the first jaw 12 when the pliers 10 are used to clamp an object. Accordingly, the member 26 limits motion in this direction thereby ensuring that pressure is applied to urge the first and second jaws 12, 16 toward each other sufficient to grasp the object there-between.

In use, the adjustment screw 30 is adjusted to accommodate the thickness of the object and the pressure that is desired. The first jaw 12 is placed around the object where space is limited and the second jaw 16 is used to pass over and around a portion of the object that would otherwise be in the way. A remaining portion of the object is contacted by the second jaw 16 and retained in position proximate the first and second jaws 12, 16 when the pivot handle 22 is urged toward the opposite handle 28. The deep throat of the second jaw 16 is at least one inch deep from the tip 20 to a bottom portion 21 thereof.

During clamping, the location of the third pivot axis 32 changes so that the third pivot axis 32 is disposed inside of a line intermediate the second pivot axis 24 and an end of the member 26 that is opposite the third pivot axis 32. This then secures the pliers 10 in a closed or locked position until a separating force is used to separate the handles 22, 28 apart from each other.

The serrations 14 are important for the primary purpose of the tool where the object includes a metal stud (not shown). The metal stud is inherently slippery and the serrations bite into the stud when the pliers 10 are closed (i.e., locked) to secure the pliers 10 to the stud and of course the stud in position, typically in a track.

The second jaw 16 includes a deep throat area 34 that resembles a "C-clamp" in appearance and is used to extend around the main body of the stud or track as desired.

Figure 2:
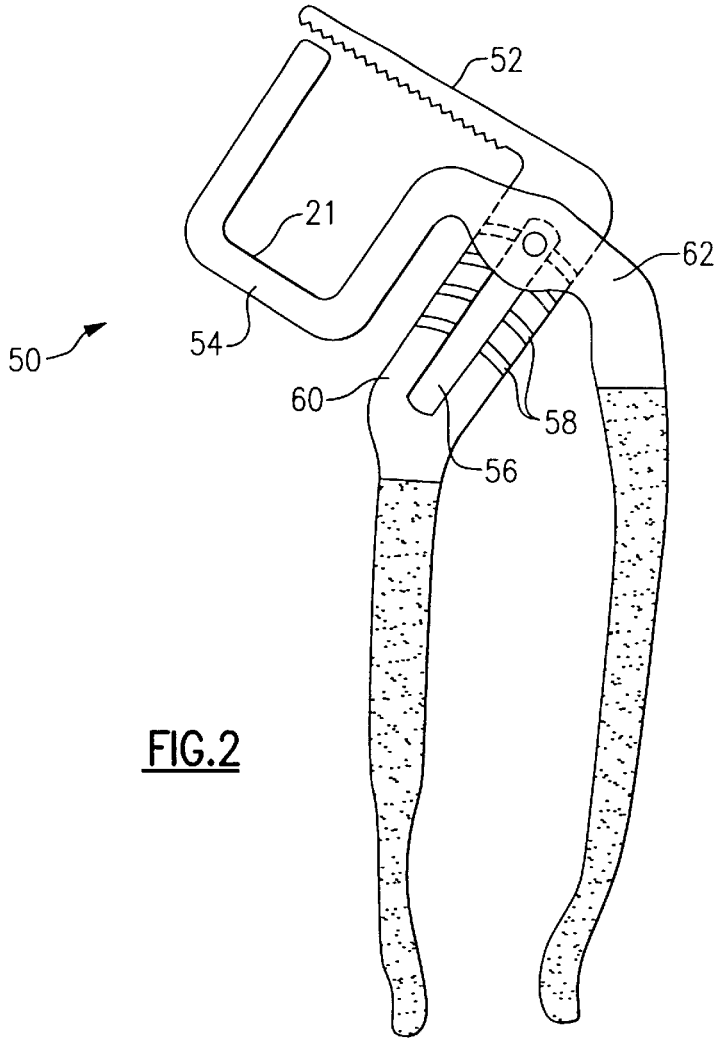
FIG. 2 is a first modified combination pliers in a channel-lock configuration.

Referring now primarily to FIG. 2, a first modified combination pliers 50 includes a modified first jaw 52 that includes the thin needle nose configuration of the first jaw 12 as described hereinabove and an opposing modified second jaw 54 that includes the deep throat C-clamp configuration of the second jaw 16 as described hereinabove.

A well known adjustable channel lock arrangement is shown that includes a longitudinal channel 56 and a plurality of arcuate grooves 58 in a first modified handle portion 60 to which the modified first jaw 52 is attached.

A second modified handle portion 62 is adapted to cooperate with the grooves 58 and channel 56 to allow the two modified jaws 52, 54 to pivot about an adjustable pivot axis 64 to or away from each other.

When the modified handles 60, 62 are fully opened, the particular groove 58 that is used is changed as the second modified handle portion 62 is moved along the channel 56. When the modified handles 60, 62 are partially closed, the position is maintained.

Applying a pressure to urge the modified handles 60, 62 toward each other urges the modified jaws 52, 54 toward each other. The object is placed there-between and secured by the serrations 14 and by the pressure intermediate the modified jaws 52, 54 for as long as pressure is applied to the modified handles 60, 62.

Accordingly, an adjustable opening size intermediate the two modified jaws 52 54 is provided in a channel-lock type of configuration.

Figure 3:
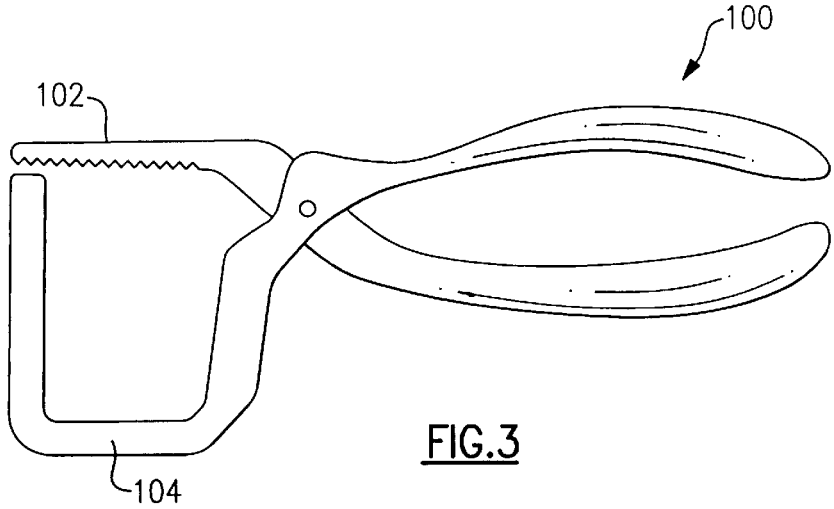
FIG. 3 is a second modified combination pliers in a standard pliers configuration.

Referring now primarily to FIG. 3, a second modified combination pliers 100 includes a modified second jaw 102 that includes the thin needle nose configuration of the first jaw 12 as described hereinabove and an opposing modified jaw 104 that includes the deep throat C-clamp configuration of the second jaw 16 as described hereinabove.

The second modified combination pliers 100 includes a standard pliers type of a configuration with the new jaw 102, 104 elements added thereto to provide an additional alternate embodiment that is useful and typically less expensive than the embodiments previously described. Accordingly, it is suitable for certain applications and also for less frequent use.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. An improved pliers, wherein the improvement comprises:

(a) a first jaw attached to a first handle wherein said first jaw includes a needle nose and wherein said first jaw includes a plurality of serrations disposed on an inside linear surface of said first jaw;

(b) a second jaw that is adapted to pivot toward and away from said first jaw wherein said second jaw includes a deep throat configuration and wherein said second jaw includes a shape that resembles a letter "C" and wherein said second jaw includes a distal end that is disposed maximally away from a handle of said pliers and wherein said distal end includes a flat portion that does not include any serrations and which is adapted to contact said first jaw; and (c) wherein said serrations in said first jaw extend along the entire length of said first jaw from said distal end to a position proximate where said first jaw merges with said handle and wherein when said distal end of said second jaw is in contact with said first jaw, said distal end is in contact with at least one of said serrations.

2. The improved pliers of claim 1 wherein said first jaw includes a thickness that is less than three-eight's of an inch.

3. The improved pliers of claim 2 wherein said second jaw includes a depth that exceeds one inch.

4. The improved pliers of claim 1 including means for releasably latching said first jaw proximate said second jaw.

5. The improved pliers of claim 1 including means for adjusting the distance intermediate said first jaw and said second jaw.

6. An improved pliers, wherein the improvement comprises:

(a) a first jaw attached to a first handle wherein said first jaw includes a needle nose and wherein a plurality of serrations are disposed on an inside linear surface of said first jaw and wherein said first jaw includes a thickness that is less than three-eight's of an inch; and (b) a second jaw that is adapted to pivot toward and away from said first jaw wherein said second jaw includes a deep throat configuration that includes a shape that resembles a letter "C" and wherein said second jaw includes a tip, said tip includes a flat portion that does not include any serrations and which is adapted to contact at least a portion of said serrations of said first jaw when said pliers are disposed in a closed position;

and wherein said serrations extend along a length of said first jaw from a first location proximate said tip for a longitudinal distance that includes the width of said deep throat of said second jaw.

* * * * *